US005614345A

United States Patent [19]

Gumbiowski et al.

[11] Patent Number: 5,614,345

[45] Date of Patent: Mar. 25, 1997

[54] PAPER FOR THERMAL IMAGE TRANSFER TO FLAT POROUS SURFACE

[75] Inventors: Rainer Gumbiowski; Rolf Ebisch, both of Osnabrück; Hartmut Schulz, Wallenhorst, all of Germany

[73] Assignee: Felix Schoeller Jr. Foto-Und Spezialpapiere GmbH & Co. KG, Osnabruck, Germany

[21] Appl. No.: 654,188

[22] Filed: May 28, 1996

Related U.S. Application Data

[63] Continuation of Ser. No. 437,012, May 8, 1995, abandoned.

[30] Foreign Application Priority Data

May 19, 1994 [DE] Germany ..... 44 17 520.5

[51] Int. Cl.[6] ..... G03C 5/52; G03C 8/26; G03C 11/12

[52] U.S. Cl. ..... 430/104; 430/126; 430/200; 430/201; 430/212; 430/213; 430/263; 430/941; 8/445; 8/468

[58] Field of Search ..... 430/263, 200, 430/126, 212, 201, 213, 941, 104; 8/445, 468

[56] References Cited

U.S. PATENT DOCUMENTS

| | | | |
|---|---|---|---|
| 4,766,053 | 8/1988 | Shinozaki et al. | 430/263 |
| 5,055,329 | 10/1991 | Namiki | 430/263 |
| 5,242,739 | 9/1993 | Kronzer et al. | 428/200 |

FOREIGN PATENT DOCUMENTS

| | | |
|---|---|---|
| 0466503 | 1/1992 | European Pat. Off. . |
| 0479882 | 4/1992 | European Pat. Off. . |
| 2653654 | 6/1977 | Germany . |
| 0228835 | 7/1987 | Germany . |
| 4210976 | 4/1993 | Germany . |
| 2236984 | 4/1991 | United Kingdom . |

*Primary Examiner*—Richard Schilling
*Attorney, Agent, or Firm*—Meltzer, Lippe, Goldstein et al.

[57] ABSTRACT

A paper for thermal image transfer to flat porous surfaces is characterized by a paper support and a layer applied thereto which contains an ethylene copolymer or an ethylene copolymer mixture and a dye-receiving layer.

14 Claims, No Drawings

PAPER FOR THERMAL IMAGE TRANSFER TO FLAT POROUS SURFACE

This is a continuation of application Ser. No. 08/437,012, filed May 8, 1995, now abandoned.

BACKGROUND, SUMMARY AND DESCRIPTION OF THE INVENTION

The invention relates to a paper for thermal image transfer to flat porous surfaces, such as textiles.

Various processes exist which enable individual, personalized images or motifs to be transferred to textiles.

One of these processes is disclosed in DE-OS 26 53 654 which relates to the creation on cloth of long-life xerographically produced images. The problem is solved by the production of a silicone-coated web having disposed thereon a cover layer on which the image is produced xerographically. The toner image on the cover layer can be further transferred to the textile material within 30 seconds by the action of heat and pressure in a laminating press at approximately 180° C.

One disadvantage of that transfer paper is the silicone coating. When after image transfer the silicone-coated paper is drawn off the textile backing, silicone residues remain sticking to the fibres of the backing. Furthermore, the images transferred to the textile material have unsatisfactory wash-fastness.

EP 0 479 882 discloses a process and the associated transfer paper for transferring motifs to a porous backing wherein the paper consists of a coated paper support containing a polyethylene layer. The images to be transferred are printed on the paper by dry copying and then transferred to the textile backing by the action of heat and pressure.

One disadvantage of the transfer paper is the unsatisfactory color density of the images transferred to the backing by means of said paper.

EP 0 466 503 A1 discloses an image carrier sheet for use in an image transfer process wherein the carrier sheet comprises a flexible web base and two layers formed thereon. One surface layer, which is directly formed on the web consist of an polymeric material, and the second layer, which is formed on the first layer, is a thermoplastic coating. For image transfer the thermoplastic coating is transferred to the textile substrate and the flexible web together with the polymeric layer is drawn off.

It is an object of the invention to develop a paper by means of which xerographically produced toner images or images produced by thermal processes can be transferred with high color density and resolution to flat porous surfaces, more particularly textile backings.

This problem is solved by a paper which is characterized by a paper support and a layer applied thereto which contains an ethylene copolymer or an ethylene copolymer mixture and a dye-receiving layer.

More particularly the copolymer contains 10 to 35 mol % of another monomer.

The ethylene copolymer can more particularly be an ethylene-vinyl acetate copolymer or an ethylene-(meth-)acrylic acid alkyl ester copolymer. However, a mixture of said copolymers can also be used.

In the particular embodiment of the invention the ethylene copolymer has a vinyl acetate or (meth)acrylic acid alkyl ester content of 10 to 35 mol%.

The ethylene/(meth)acrylic acid alkyl ester-copolymer can be selected from the group formed by the following copolymers:

Ethylene/methyl(meth)acrylate, ethylene/ethyl-(meth)acrylate, ethylene/propyl(meth)acrylate, ethylene/n-butyl(meth)acrylate or ethylene/isobutyl(meth)acrylate and also mixtures thereof.

The layer containing the ethylene copolymer is extruded on to a paper support. The coating weight of the layer is 10 to 50 g/m$^2$. Prior to the extrusion coating, the surface of the paper is subjected to a corona discharge.

Any paper can be used as the paper support, but a high-sized neutral basic paper having a base weight of 60 to 200 g/m$^2$ is more particularly suitable. The base paper can be surface sized with starch or polyvinyl alcohol and has on both sides a surface smoothness of 20 to 300 Bekk.

The dye-receiving layer applied to the layer containing an ethylene copolymer contains a polymer of low film forming temperature.

The polymer can be more particularly an acrylic acid ester copolymer, a styrene/butadiene or an acrylonitrile butadiene-latex. However, it is also possible to use other polymers which have a good affinity with the dye or toners used for printing.

In another embodiment of the invention the dye-receiving layer can also contain an antiadhesive agent. Finely dispersed silicas, more particularly an aluminium-doped finely dispersed silica are particularly suitable for this purpose.

The paper quality may further be improved in view of the ability to be pitted up and with view to a regular undisturbed passage during the reproduction onto the paper, when the dye-receiving layer additionally contains inorganic and/or organic pigments.

Particularly preferred are hollow or other resin particles on the basis of styrene resins as polystyrene or on the basis of acrylic resins as polymethyl(meth)acrylate or styrene/acrylic acid alkylester-copolymers. Starch is well suited and has to be regarded as pigment, because it is directly admixed to the coating solution and suspended therein.

Suitable inorganic pigments are $TiO_2$, $CaCO_3$, ZnO, ZnS, $ZnSO_4$, $Sb_2O_3$, $CaSO_4$, kaolin, talcum or mixtures thereof.

The amount of the pigment in the dye receiving layer is between 10 to 90 wt %, preferably 30 to 70 wt %, based on the dry layer.

The above mentioned improved properties are evaluated by determining a friction coefficient with a tractive force testing apparatus according to the Frank principle.

Use of pigments in the dye receiving layer results in friction coefficients of less than 4N. The friction coefficient is the force which is required to dislocate the back side of a sheet compared to its front side.

The dye-receiving layer is applied from an aqueous coating solution. All the usual application and metering methods can be used for this purpose. The coating weight of the dye-receiving layer is 0.1 to 0.5 g/m$^2$.

Non-impact methods such as, for example, laser printers and laser copiers can be used to print on the surface of the paper according to the invention any desired motif, which can then be transferred to all synthetic or natural fabrics, but also to other flat articles. To this end the paper bearing a motif is brought into contact with a flat backing. The transfer is performed by the action of heat (130°–180° C.) and pressure ($34.5\times10^4$ N/m$^2$), and only the paper support is thereafter drawn off the backing. The transferred image penetrates completely into the fibres of the backing.

In comparison with the conventional transfer papers or those disclosed by the prior art, the following advantages may be mentioned:

- increased brilliance of color (improved color reproduction);
- uniform trouble-free flow during reproduction on the paper according to the invention;
- improved stackability;
- wash-fastness of the transferred image on the textile material;
- complete separation of the printed layer, without residues on the paper drawn off;
- environmentally acceptable image transfer, since after removal only the uncoated paper support is left.

The invention will now be described in greater detail with reference to the following Examples.

EXAMPLE 1

The front side of a neutrally sized base paper having a basis weight of 80 g/m$^2$ was subjected to a preliminary corona treatment and then extrusion coated with the copolymers or copolymer mixtures stated in the following Table, whereafter it was coated with an aqueous dispersion of a carboxylated styrene/butadiene copolymer (4.5% by weight solid content) and dried (coating weight 0.2 g/m$^2$).

| | Composition, % by weight | | | | | |
|---|---|---|---|---|---|---|
| Copolymer | 1a | 1b | 1c | 1d | 1e | 1f |
| Ethylene/vinyl acetate with 33 mol % vinyl acetate (ELVAX 150-W, Du Pont) | 100 | — | — | — | — | — |
| Ethylene/vinyl acetate with 28 mol % vinyl acetate (Evatane 28/40, Elf Atochem) | — | 100 | — | — | — | 25 |
| Ethylene/vinyl acetate with 14 mol % vinyl acetate (Escorene Ultra 00714, Exxon) | — | — | 100 | — | — | — |
| Ethylene/n-butyl acrylate with 35 mol % n-butyl acrylate (Enathene EA 80808, Quantum) | — | — | — | 100 | — | 75 |
| Ethylene/methyl acrylate with 15 mol % methyl acrylate (Lotryl 15 MA 03, Elf Atochem) | — | — | — | — | 100 | — |
| Coating weight g/m$^2$ | 15 | 25 | 35 | 20 | 20 | 20 |

All the coatings were carried out in a melting temperature range of 180° to 250° C. and at a machine speed of 110 m/min. Papers coated in this way were furnished with images by a copying process (laser printer) and then brought into contact with a textile backing (100% cotton fabric) in a press in which the images were transferred to the textile backing by heat (180° C.) and pressure (34.5×10$^4$ N/m$^2$). After the transfer the paper support was pulled off.

The printed textile backing was washed at 30° C. using conventional detergents and then subjected to expert examination.

EXAMPLE 2

The paper, coated with ethylene/vinyl acetate-copolymer (28 mol % vinyl acetate) was coated with the following aqueous dispersions:

| | composition, % by weight | | | |
|---|---|---|---|---|
| Components | 2a | 2b | 2c | 2d |
| Acrylic acid ester/vinyl acetate vinyl chloride copolymer 50% disp. (Acronal 300 D, BASF) | 10 | — | 10 | — |
| Carboxylated acrylic acid ester 32% disp. (Carboset XPD 1242, Goodrich) | — | 15 | — | — |
| Carboxylated styrene/butadiene-latex 50% disp. (Dow Latex 945, Dow Chem.) | — | — | — | 10 |
| Pyrogenic silica 10% in water (Cab-o-sil M5, Cabot GmbH) | — | — | — | 30 |
| Al-doped finely dispersed silica 30% in water (Ludox AM, Du Pont) | — | — | 10 | — |
| water | 90 | 85 | 80 | 60 |
| Application weight g/m$^2$ | 0.15 | 0.15 | 0.25 | 0.3 |

The coating masses were applied to the surface to be coated using a system of roll coater metered with a smooth doctor blade and dried in a hot air channel at air temperatures of approximately 80° C. The machine speed was 100 m/min.

The papers coated in this manner were printed with images by a copying process and then brought into contact with a textile backing, as in Example 1. After the image had been transferred, the paper support was pulled off the textile backing.

The printed textile backing was washed at 30° C. and then subjected to expert examination.

Comparison Example

A transfer paper produced in accordance with EP 0 479 882 was printed with images as in Example 1 and used for image transfer to a textile backing as in Example 1.

Test Results

The papers produced in accordance with the Examples were printed with images by means of a laser printer and then brought into contact with a textile backing. When the image had been transferred, the color density of the printed textile backing was measured.

The density measurements were performed prior to and following a washing operation using conventional detergents at 30° C. The apparatus used for this purpose was an SOS-45 Original Reflection Densitometer. The measurements were performed for the basic colors yellow, cyan, magenta and black.

The results shown in Table 1 indicate that the transfer papers produced according to the invention enable images to be transferred with higher values of color density. However, attention must be drawn more particularly to the lower density loss following on washing operation.

TABLE 1

Test Results

| | Color density | | | | | | | |
|---|---|---|---|---|---|---|---|---|
| | yellow | | cyan | | magenta | | black | |
| Example | a | b | a | b | a | b | a | b |
| 1a | 0,15 | 0,13 | 0,74 | 0,54 | 0,78 | 0,60 | 1,58 | 0,77 |
| 1b | 0,14 | 0,12 | 0,72 | 0,53 | 0,76 | 0,58 | 1,55 | 0,70 |
| 1c | 0,13 | 0,11 | 0,65 | 0,36 | 0,77 | 0,51 | 1,42 | 0,58 |
| 1d | 0,14 | 0,11 | 0,70 | 0,52 | 0,76 | 0,59 | 1,56 | 0,78 |
| 1e | 0,13 | 0,12 | 0,66 | 0,38 | 0,75 | 0,54 | 1,48 | 0,61 |
| 1f | 0,14 | 0,12 | 0,72 | 0,54 | 0,76 | 0,60 | 1,56 | 0,72 |
| 2a | 0,14 | 0,13 | 0,74 | 0,55 | 0,78 | 0,60 | 1,60 | 0,80 |
| 2b | 0,15 | 0,13 | 0,74 | 0,57 | 0,78 | 0,60 | 1,58 | 0,78 |
| 2c | 0,14 | 0,12 | 0,75 | 0,60 | 0,77 | 0,59 | 1,55 | 0,85 |
| 2d | 0,14 | 0,13 | 0,74 | 0,58 | 0,77 | 0,60 | 1,56 | 0,82 |
| Comparison | 0,17 | 0,10 | 0,61 | 0,33 | 0,71 | 0,40 | 1,31 | 0,53 |

a — prior to washing
b — after washing at 30° C.

What we claim:

1. A paper for thermal image transfer to a flat porous surface, comprising a paper support, an intermediate layer on said paper support, said intermediate layer containing an ethylene copolymer or an ethylene copolymer mixture, and a dye-receiving layer on said intermediate layer, said dye-receiving layer having a coating weight in the range of 0.1 to 0.5 g/m$^2$; wherein said dye-receiving layer is bonded to said intermediate layer such that when an image is transferred to a flat porous surface, said intermediate layer remains bonded to said dye-receiving layer while said paper support separates from said intermediate layer.

2. The paper of claim 1 wherein said copolymer contains 10 to 35 mol % of a monomer other than ethylene.

3. The paper of claim 1 wherein said ethylene copolymer is an ethylene/vinyl acetate copolymer.

4. The paper of claim 1 wherein said ethylene copolymer is an ethylene/(meth)acrylic acid alkyl ester copolymer.

5. The paper of claim 1 wherein said dye-receiving layer comprises a film forming polymer.

6. The paper of claim 5 wherein said film-forming polymer is an acrylic acid ester copolymer, styrene/butadiene-latex, or acrylonitrile/butadiene-latex.

7. The paper of claim 1 wherein said dye-receiving layer further comprises an antiadhesive agent.

8. The paper of claim 7 wherein said antiadhesive agent is a silica.

9. The paper of claim 8 wherein said silica is an aluminum-doped finely divided silica.

10. The paper of claim 1 wherein said dye-receiving layer further comprises a pigment.

11. The paper of claim 10 wherein said pigment comprises 10–90 wt % of the dry weight of said dye-receiving layer.

12. The paper of claim 10 wherein said pigment comprises 30–70 wt % of the dry weight of said dye-receiving layer.

13. The paper of claim 10 wherein said dye-receiving layer has a coefficient of friction of less than 4N.

14. The paper of claim 1 wherein said intermediate layer has a coating weight in the range of 10 to 50 g/m$^2$.

* * * * *